US009744568B2

(12) United States Patent
Jalowiec

(10) Patent No.: US 9,744,568 B2
(45) Date of Patent: Aug. 29, 2017

(54) DUST LIMITING INSULATION COLLECTION BAG AND METHOD OF COLLECTING INSULATION

(71) Applicant: Thomas Walter Jalowiec, Sauquoit, NY (US)

(72) Inventor: Thomas Walter Jalowiec, Sauquoit, NY (US)

( * ) Notice: Subject to any disclaimer, the term of this patent is extended or adjusted under 35 U.S.C. 154(b) by 0 days.

(21) Appl. No.: 15/089,307

(22) Filed: Apr. 1, 2016

(65) Prior Publication Data

US 2016/0297609 A1 Oct. 13, 2016

Related U.S. Application Data

(60) Provisional application No. 62/145,181, filed on Apr. 9, 2015.

(51) Int. Cl.
*B08B 5/04* (2006.01)
*A47L 7/00* (2006.01)

(52) U.S. Cl.
CPC ..... *B08B 5/04* (2013.01); *A47L 7/0071* (2013.01)

(58) Field of Classification Search
CPC ..... B08B 5/04; A47L 7/0071; B65F 5/005; B65F 2250/1143; B65F 2250/1146; B65D 33/01
USPC ..... 134/21, 22.1
See application file for complete search history.

(56) References Cited

U.S. PATENT DOCUMENTS 4,812,700 A * 3/1989 Natale ..... B08B 9/023 134/21
7,195,678 B1 * 3/2007 Wall ..... B09B 3/0066 134/152

* cited by examiner

*Primary Examiner* — Eric Golightly
(74) *Attorney, Agent, or Firm* — Jeffrey S. Melcher; Manelli Selter PLLC

(57) ABSTRACT

A method of removing insulation from a building, comprising: providing a vacuum device, a first end of an inlet hose connected to an inlet of the device, and a first end of an exit hose connected to an outlet of the device; providing a bag comprising a sheet of non-porous plastic, heat sealed to form the bag, the bag having inlets spaced out along a top of the bag, and a filter connected to the bag for allowing air to solely escape the bag through the filter; connecting an inlet of the bag to a second end of the exit hose, and operating the vacuum device to suck insulation into the inlet hose, through the vacuum device, and propel the insulation through the exit hose and into the bag so that the insulation flows through the top of the bag in a direction towards a bottom of the bag.

7 Claims, 3 Drawing Sheets

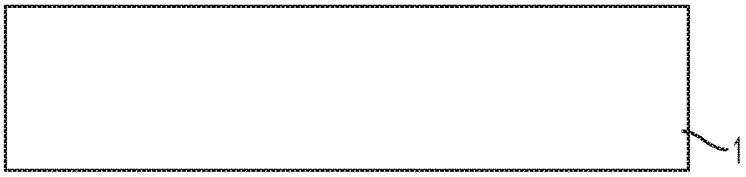
FIG. 2 [Prior Art]
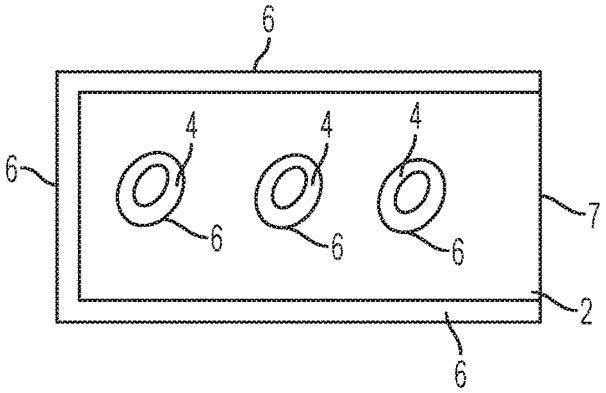
FIG. 3
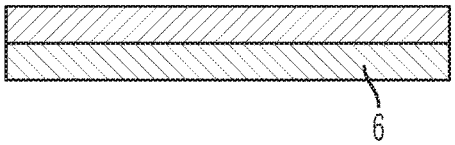
FIG. 4
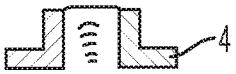
FIG. 5

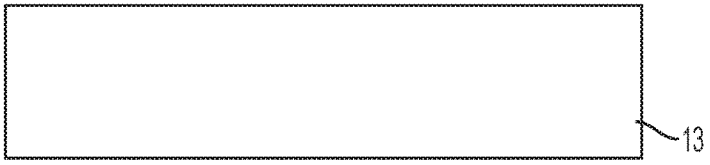
FIG. 6 [Prior Art]
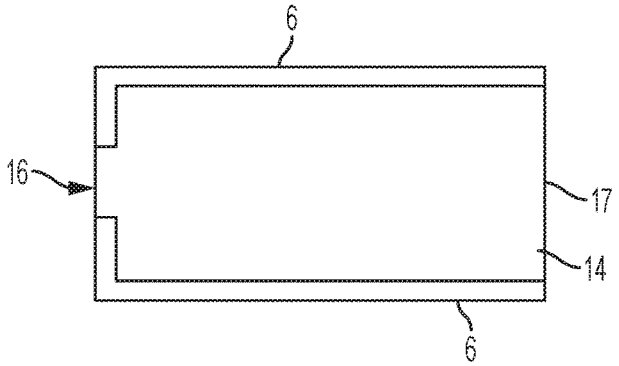
FIG. 7
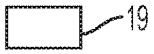
FIG. 8 [Prior Art]
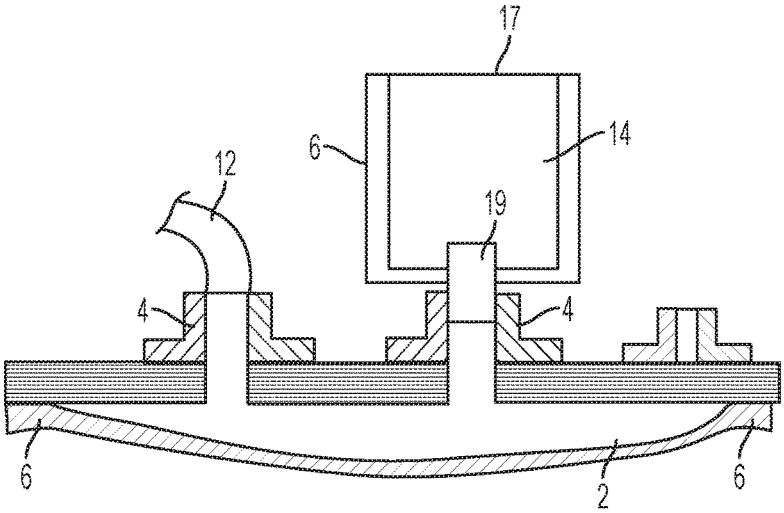
FIG. 9

DUST LIMITING INSULATION COLLECTION BAG AND METHOD OF COLLECTING INSULATION

This application claims priority to U.S. Provisional Application Ser. No. 62/145,181, filed 9 Apr. 2015, the complete disclosure of which is incorporated herein by reference.

FIELD OF THE INVENTION

The invention relates to a dust limiting collection bag for collecting used insulation and a method of collecting used insulation.

BACKGROUND OF THE INVENTION

Insulation is often removed from residential and commercial buildings using vacuum devices, such as BruteVac, Accu-1, intec-vortec-attic-insullation-vacuum, or any other machine that creates a vacuum. A vacuum hose (inlet hose) is connected to the inlet of the vacuum device for sucking up insulation. The insulation passes through the vacuum device and then into an exit hose connected to an insulation collection bag. The inlet and outlet, and hoses are typically 6 inches in diameter.

Conventional bags are formed of a porous material and lack air filters and are side loading, i.e. the inlet is located on one side of the bag. Thus, their ability to contain the harmful dust created by the removal of fiberglass and cellulose insulation is negligible. Typically, the insulation bags are porous and allow the air to penetrate the bag, along with harmful insulation dust. Furthermore, conventional insulation bags are too small. Because the amount of insulation that is normally removed is much larger than the capacity of one or more of the existing small conventional bags, someone is always required to stay with the bags as they fill up and to constantly change them thus making the use of conventional bags more labor intensive and less efficient. In addition, sharp objects often penetrate the bag and travel through the air causing a hazardous situation.

Dump trucks and dumpsters having a tarp covering them have been used in place of the bag. However, these uses make a huge mess by spreading insulation around the yard.

There is a need for improved insulation bags that avoid the problem of insulation dust, avoid the need for someone to change the bag, and reduce the risk of sharp object being propelled from the bag.

SUMMARY OF THE INVENTION

An objective of the invention is to provide an improved insulation bag that filters the air leaving the bag and prevents insulation dust from leaving the bag.

Another object of the invention is to provide a large bag that avoids the need for someone to change the bag.

A further object of the invention is to provide a bag in which sharp projectiles cannot escape the bag.

The objects of the invention and other objectives can be obtained by a method of removing insulation from a building:

providing a vacuum device, a first end of an inlet hose connected to an inlet of the vacuum device, and a first end of an exit hose connected to an outlet of the vacuum device;

providing a bag comprising a sheet of non-porous, heat-sealable, plastic that has been heat sealed to form the bag, the bag having a plurality of inlets spaced out along a top of the bag, and a filter connected to the bag for allowing air to solely escape the bag through the filter;

connecting an inlet of the bag to a second end of the exit hose, and operating the vacuum device to suck insulation into the inlet hose, through the vacuum device, and propel the insulation through the exit hose and into the bag so that the insulation flows through the top of the bag in a direction towards a bottom of the bag to avoid sharp objects penetrating the bag and flying through air.

The objects of the invention and other objectives can also an insulation collection bag constructed to collect insulation from a building comprising:

a sheet of non-porous, heat-sealable, plastic sheet that has been heat sealed to form a bag;

a plurality of inlets spaced out along a top of the bag constructed and sized to connect to an exit hose of a vacuum device; and a filter connected to the bag constructed to allow air to solely escape the bag through the filter.

The objectives of the invention can be further met by a method of making an insulation collection bag comprising:

folding a sheet of non-porous, heat-sealable, plastic so that a first part of the sheet lies on top of the a second part of the sheet;

heat sealing unfolded sides of the sheet together to form the bag so that the first part of the sheet forms the top of the bag and the second part of the sheet forms the bottom of the bag;

sealing a plurality of inlets to the bag so that the inlets are spaced apart along a top of the bag; and connecting a filter to the bag.

BRIEF DESCRIPTION OF THE DRAWINGS

FIG. 2 [Prior Art] illustrates a sheet of heat sealable plastic.

FIG. 3 illustrates a bag formed from the sheet.

FIG. 4 illustrates a side view of a heat weld.

FIG. 5 illustrates an unmounted inlet.

FIG. 6 [Prior Art] illustrates a sheet of filter material.

FIG. 7 illustrates a filter bag.

FIG. 8 [Prior Art] illustrates a stove pipe.

FIG. 9 illustrates a bag having a filter bag mounted and being connected to an exit hose.

DETAILED DESCRIPTION OF THE INVENTION

Figure 1:
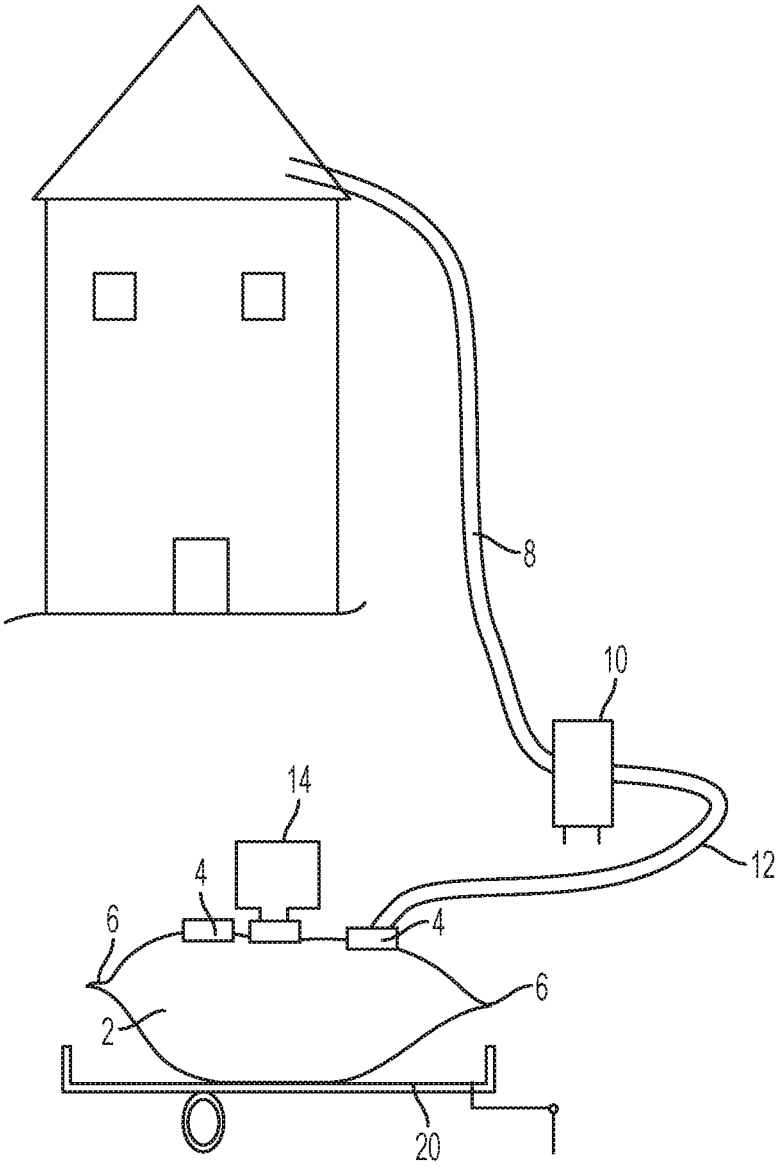
FIG. 1 illustrates an embodiment of the invention in which the bag is connected to a suction device for removing insulation from a building.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a dust limiting collection bag for loose fill insulation removal. The bags of the present invention can be made to suit any size project. The bags can be made far larger than conventional bags in order to hold large amounts of loose insulation. Regardless of the size of the project, the present invention would allow one person to operate the machine and one would not have to specifically employ a second person to constantly remain with the bag since the need to change out bags would no longer be an issue. As a result of the bag having an air filter, there is minimal exposure to insulation dust escaping into the atmosphere. The full bag can simply be discarded with the insulation at a dumpsite.

The present invention can be formed of a heat sealable plastic and an air filter material. When compared to other bags, the present invention has the following advantages: first, it reduces the amount of dust exposure as a result of using an air filter system; second, the bags can be made much larger than the conventional bags, thus eliminating the need to constantly change bags; and third the bag and inlet are constructed so that sharp objects are not propelled from the bag.

The bag is preferably formed by folding a sheet of non-porous, heat-sealable, plastic so that a first part of the sheet lies on top of a second part of the sheet. Examples of suitable non-porous heat-sealable, plastic sheets include, but are not limited to, commonly available polyethylene or polypropylene sheets in any desired thickness, such as 2-10 mil thickness. The unfolded sides of the sheet are then heat sealed together to form the bag so that the first part of the sheet forms the top of the bag and the second part of the sheet forms the bottom of the bag. A plurality of inlets are then sealed to the bag so that the inlets are spaced apart along a top of the bag. The inlets can also be formed of the non-porous heat-sealable, plastic. A filter is connected to the bag so that air only flows from the bag through filter.

The filter material can be sized to match the air flow of the vacuum system to allow the air to leave the bag. A preferred example of a filter material is conventional landscaping fabric.

An example of the invention is shown in the non-limiting FIGS. 1-9. The heat sealable plastic sheet 1 is first cut to form the desired size bag 2. For example, if a bag 2 having a length of 20 feet and a width of 10 feet is desired, a plastic sheet 1 can be cut to 20 feet by 20 feet and folded in half so that half of the sheet lies on top of the other half of the sheet to form a 20 feet by 10 feet bag 2. Thus, one side of the bag 2 is sealed by the fold 7. The remaining three sides are then heat sealed 6 to seal the bag 2. Preferably, at least a 0.5 inch heat seal is provided. Any conventional heat sealer can be utilized, such as those made by Plexpack. The Plexpack can heat weld a 0.5 inch seam at a rate of up to 500 inches/minute. The heat sealed edges can be further reinforced by tape, such as duct tape, as desired. Examples of suitable heat sealable plastic sheets include polyethylene and polypropylene. For example, the bag can be sized to fit a trailer 20, common sizes being 10 feet wide by 20 feet long, 10 feet wide by 15 feet long, and 10 feet wide by 10 feet long. When the bag is inflated a 10 foot wide bag will fit on an 8 foot wide trailer. Preferred sizes of the bag are at least 50 square feet, more preferably at least 100 square feet, and can be made any size, for example up to 500 square feet, and if large trailers are used up to 1000 square feet, measured on a top side of the bag when the empty bag is laid flat.

A plurality of inlets 4, preferably 2-4 inlets, are heat sealed or otherwise bonded to the bag 2 so that the inlets 4 are spaced apart along a top of the bag 2. Parchment paper can be used to prevent sticking of the melted plastic to the heat sealer. In this manner, the insulation and any sharp objects enter the bag in a direction towards a bottom of the bag so that the sharp objects strike insulation present in the bag and/or the bottom of the bag and surface on which the bag 2 rests, which greatly reduces the chance of the sharp object being propelled from the bag 2. The inlets 4 are preferably spaced along the top of the bag so that the exit hose 12 can be connected to different inlets 4 to fill different parts of the bag 2 as desired. The inlets 4 can be formed from a heat sealable plastic sheet. The inlets 4 are preferably sealed and can be cut open just before use. The inlets 4 are sized to connect to an exit hose 12. The inlets 4 can be connected to the exit hose 12 using any desired connection, such as duct tape 18 or other tape, or clamps. The inlets 4 can be sized to seal with the exit hose 12 and conventional stove pipe 19 sizes, which are typically from 4 to 8 inches in diameter. Preferably, the inlets 4 are 6 inches in diameter.

A filter bag 14 can be formed of any filter material that is suitable for insulation. A preferred filter material is landscape fabric. Commercial examples of landscape fabric include Sta-Green, Blue Hawk, Scotts, Dewitt and ProMat. Preferred landscape fabric is formed from woven or non-woven heat sealable plastic fibers, such as polypropylene or polyethylene. The landscape fabric is sold in sheets. The landscape fabric sheet can be folded 17 and three sides 16 heat sealed while leaving an opening 16 to form a filter bag 14. The opening 16 of the filter bag 14 can be connected to an inlet 4 by heat sealing or other connections, such as tape or clamps using a section of stove pipe 19. The size of the filter bag 14 can be adjusted for the air flow output of the vacuum device 10. Examples of suitable sizes are 1 square foot to 20 square feet for one side of the empty bag.

The heat sealable plastic that is used to form the bags 2 is nonporous and does not let anything through it, including the smallest particles of dust and air. The air filter 14 allows air to escape from the bag 2 in order to maintain the integrity of the bag 2 and at the same time keeping to a minimum the escape of dust or other particles. The heat sealed seams 6 do not rip or break easily. The bags 2 can be made at almost any dimension, allowing them to hold a lot of volume, or to fit perfectly in a dumpster or dump trailer.

Also provided is a method of using the bag 2. The method comprises providing a vacuum device 10, a first end of an inlet hose 8 connected to an inlet of the vacuum device 10, and a first end of an exit hose 12 connected to an outlet of the vacuum device 10. A bag 2 as described herein is provided comprising a sheet of non-porous, heat-sealable, plastic that has been heat sealed to form the bag 2, the bag 2 having a plurality of inlets 4 spaced out along a top of the bag 2, and a filter 14 connected to the bag for allowing air to solely escape the bag 2 through the filter 14. An inlet of the bag 2 is connected to a second end of the exit hose 12. The vacuum device 10 is operated to suck insulation into the inlet hose 8, through the vacuum device 10, through the exit hose 12 and into the bag 2 so that the insulation flows through the top of the bag 2 in a direction towards a bottom of the bag 2 to avoid sharp objects penetrating the bag 2 and flying through air. During use, all air exits the bag 2 only through the filter 14. The insulation and any sharp objects, such as nails, carried with the insulation travel in the direction from the top of the bag 2 to the bottom of the bag 2 so that the sharp objects strike the bottom of the bag 2 and the surface the bag 2 is laying on or insulation in the bag 2, so that the sharp object cannot be propelled from the bag 2. The bag 2 is preferably provided on a truck, trailer or roll off dumpster 20 and sized to fit the truck, trailer or roll off dumpster 20.

During use the exit hose 12 can be moved to a different inlet 4. The inlet 4 that is no longer being used can be taped shut. When the job is completed the bag 2 containing the insulation can be slid off the truck, trailer or roll off dumpster 20 when done.

While not preferred, the exit hose 12 can be connected to different parts of the bag 2, such as on a side of the bag. In this embodiment, the inlet 4 can be on the side of the bag 2. During filing of the bag 2, exit hose 12 can be inserted to different depths inside the bag 2.

It should be understood, of course, that the foregoing relates to exemplary embodiments of the invention and that modifications may be made without departing from the spirit and scope of the invention as set forth in the following claims.

The invention claimed is:

1. A method of removing insulation from a building:

providing a vacuum device, a first end of an inlet hose connected to an inlet of the vacuum device, and a first end of an exit hose connected to an outlet of the vacuum device;

providing a bag comprising a sheet of non-porous, heat-sealable, plastic that has been heat sealed to form the bag, the bag having a plurality of inlets spaced out along a top of the bag, and a filter connected to the bag for allowing air to solely escape the bag through the filter;

connecting an inlet of the bag to a second end of the exit hose, and operating the vacuum device to suck insulation into the inlet hose, through the vacuum device, and propel the insulation through the exit hose and into the bag so that the insulation flows through the top of the bag in a direction towards a bottom of the bag to avoid sharp objects penetrating the bag and flying through air.

2. The method according to claim 1, wherein the heat-sealable plastic comprises polypropylene or polyethylene.

3. The method according to claim 1, wherein the filter is formed from landscape fabric.

4. The method according to claim 1, wherein the filter is formed from polypropylene or polyethylene fibers.

5. The method according to claim 1, wherein the filter is in the form of a filter bag and the filter bag is connected to an inlet.

6. The method according to claim 1, further comprising providing a trailer, truck or roll off dumpster, wherein the bag is sized to fit the trailer, truck or roll off dumpster, the bag having at least 50 square feet of surface area when deflated and laid flat, and when insulation removal is complete, sliding the bag containing the insulation off of the trailer, truck or roll off dumpster.

7. The method according to claim 1, further comprising moving the exit hose to a different inlet on the bag.

* * * * *